United States Patent [19]

Holt

[11] Patent Number: 4,553,809

[45] Date of Patent: Nov. 19, 1985

[54] ELECTRICAL CONNECTOR

[75] Inventor: Neil L. Holt, Foster City, Calif.

[73] Assignee: Raychem Corporation, Menlo Park, Calif.

[21] Appl. No.: 654,602

[22] Filed: Sep. 24, 1984

[51] Int. Cl.[4] ..... H01R 11/06

[52] U.S. Cl. ..... 339/275 T; 174/84 R

[58] Field of Search ..... 339/275; 174/74 R, 74 A, 174/84 R, 90; 236/100

[56] References Cited

U.S. PATENT DOCUMENTS

| | | | |
|---|---|---|---|
| 2,368,181 | 1/1945 | Vernet | 236/100 |
| 3,243,211 | 3/1966 | Wetmore | 174/84 R |
| 3,525,799 | 8/1970 | Ellis | 174/84 R |
| 4,283,596 | 8/1981 | Vidakovits | 174/84 R |

*Primary Examiner*—Joseph H. McGlynn
*Attorney, Agent, or Firm*—Edith A. Rice; Herbert G. Burkard

[57] ABSTRACT

An electrical connector comprising at least one metallic tubular sleeve having an open end for receiving an electrical conductor and a closed end, the peripheral inner wall of the sleeve being pretinned; a slug of solder, having a flux associated therewith, hermetically sealed within the sleeve proximate the closed end; a piston positioned between the closed end and the slug and capable of axial motion within the sleeve; means which on application of sufficient heat to raise the temperature of the connector to a first temperature, $T_1$, which is the activation temperature of the flux, breaks the hermetic seal, permits the flux and gaseous products thereof to expand and flow toward the conductor; and pressuring means between the piston and the closed end of the sleeve which, on application of sufficient heat to raise the temperature of the connector to a second temperature, $T_2$, which is higher than the first temperature and which is the melting temperature of the solder, exerts sufficient force on the piston to cause it to move toward the open end of the sleeve and to pressure the slug of solder toward the open end of the sleeve.

5 Claims, 2 Drawing Figures

ELECTRICAL CONNECTOR

BACKGROUND OF THE INVENTION

This invention relates to an electrically conductive connector for electrical conductors.

In commonly assigned U.S. patent application Ser. No. 483,997, filed Apr. 11, 1983, there is disclosed an electrically conductive connector for electrical conductors. The connector comprises a metal sleeve having a closed end and an open end. A solid slug of solder is positioned in the connector adjacent the closed end thereof and a conductor is then inserted. In some embodiments, when sufficient heat is applied to melt the solder, a pressuring means forces the solder between the conductor and the side walls of the connector and, if a stranded conductor is used, between the strands of the conductor. When cooled, the solder solidifies making a solid electrical and physical joint between the conductor and the connector. A preferred pressuring means comprises a piston and a gas-evolving composition positioned between the piston and the closed end of the conductor. On heating, gas is evolved and creates a pressure behind the piston. On continued heating, the solder melts and the pressure of the evolved gas causes the piston to move axially in the connector toward the open end, pressuring the molten solder and forcing it to flow between the conductor and connector. A preferred piston for use in this embodiment is that described in commonly assigned U.S. patent application Ser. No. 604,791, filed Apr. 27, 1984.

In utilizing a connector of the type described in Ser. No. 483,997, it is desirable to use a flux together with the solder. Preferably, the solder is a cored solder containing flux in cavities within the solder slug. Generally the slug of solder used is cylindrical and the flux is located in several cylindrical bores running the length of the solder. It has been found on storage of such a connector for periods of time typical of shelf-life requirements for such a product, that the flux tends to oxidize, absorb moisture, decompose or otherwise to become deactivated. To prevent this, the solder slug is preferably hermetically sealed in the connector to isolate it from the environment. In such an arrangement, it has been found that when heat is applied, the flux activates, giving off gas which creates sufficient pressure to dislodge the conductor being connected. It has also been found that when using the electrical connector with relatively large diameter conductors, e.g., above about 120 square millimeters, an adequate solder bond is not formed. This is particularly true for stranded conductors, as the central strands of the conductor do not form the desired solid soldered connection.

The present invention is directed to an electrical connector which overcomes the problems associated with the prior art devices.

SUMMARY OF THE INVENTION

One aspect of this invention provides an electrically conductive connector for electrical conductors comprising:

(a) at least one metallic tubular sleeve having an open end for receiving an electrical conductor and a closed end, the peripheral inner wall of the sleeve being pretinned;

(b) a slug of solder having a flux associated therewith, hermetically sealed within the sleeve proximate the closed end;

(c) a piston, capable of axial motion within the sleeve, positioned between the solder slug and the closed end;

(d) means which on application of heat sufficient to raise the temperature of the connector to a first temperature, $T_1$, the activation temperature of the flux, breaks the hermetical seal and permits the activated flux to expand and flow toward the conductor; and (e) pressuring means positioned between the piston and the closed end of the sleeve which, on application of heat sufficient to raise the temperature of the connector to a second temperature, $T_2$, which is higher than the first temperature and which is the melting temperature of the solder, exerts sufficient force on the piston to cause it to move toward the open end of the sleeve and to pressure the slug of solder toward the open end of the sleeve.

DETAILED DESCRIPTION OF THE INVENTION

Figure 1:
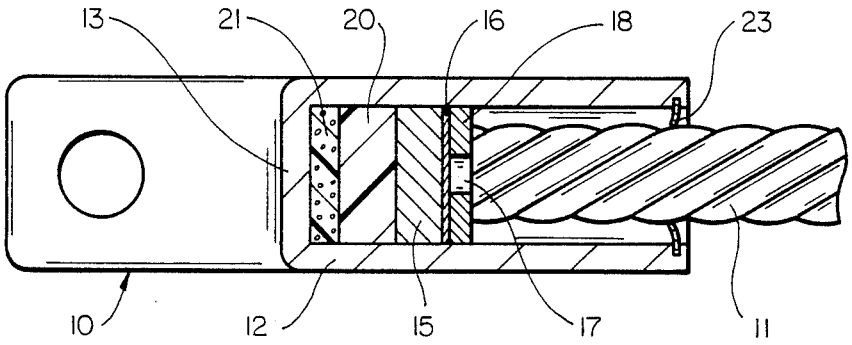
FIG. 1 shows a tranverse cross-section of an electrical connector (in the form of a terminating lug) of this invention with the electrical conductor to be joined to the connector inserted therein.

FIG. 1 illustrates an electrical connector of this invention. The connector shown in FIG. 1 is a terminating lug having one open end and is provided at the other end thereof, with an aperature for bolting the lug onto an electrical apparatus such as switchgear, transformer or the like. As described in U.S. application Ser. No. 483,997, filed Apr. 11, 1983, the disclosure of which is incorporated herein by reference, two metallic sleeves each closed at one end can be butted together to form a connector for forming a joint between two conductors. In a preferred embodiment, the jointing connector comprises a single metallic sleeve with a dividing wall separating the sleeve into two relatively equal portions. Each portion comprises an electrical connector as defined in this application.

As shown in FIG. 1, the electrical connector 10 comprises a sleeve 12 having a closed end 13 which in the illustrated embodiment forms a terminating lug. The peripheral inner wall of the sleeve is pretinned to optimize the solder bond between the conductor and the connector. The term "pretinned" is used to mean that a surface has been coated with solder or a material which readily bonds to solder. Preferably the surface is coated with solder, zinc, tin, or bronze.

The inner diameter of the sleeve is determined by the size of the electrical conductor 11 to be connected thereto. Electrical conductors used in electrical power distribution systems range in size from about 35 square millimeters to about 1000 square millimeters. The electrical connector of this invention is particularly advantageous when used with stranded conductors ranging in size from about 70 square millimeters to 500 square millimeters. Such conductors are typically of aluminum or copper.

The metallic sleeve of the connector is preferably the same metal as the conductor, that is aluminum or copper but can be of any highly conductive metal.

The particular solder used depends on the metal of the conductor and connector. The temperature at which the solder melts, that is $T_2$, typically is about 180° to about 400° C. and preferably at about 300° C. A preferred solder for joining an aluminum conductor to an aluminum sleeve is an alloy of tin, silver and lead commercially available from Multicore Solder, Ltd., under the trademark HMP Alloy.

It is preferred to use flux in association with the solder. The flux can be associated with the solder in any convenient manner; for example, the flux can be coated on the outside of the solder. It is preferred, however, to use a cored solder, that is solder containing flux within a cavity in the solder, in particular a multi-cored solder. As the slug of solder is to be positioned within a cylindrical sleeve it is preferred that it be cylindrical in shape but need not be. The flux preferably contains a plurality of bores extruding longitudinally through its cylindrical shape with flux contained in each bore. The flux can comprise any flux suitable for use with the solder used. Typical solder fluxes comprise rosin-based compositions.

The activation temperature of the flux, that is $T_1$, is lower than the melting temperature of the solder, that is, $T_1$ is lower than $T_2$. Depending on the solder and flux used, the activation temperature of the flux can be from about 160° C. to about 380° C., providing the activation temperature of the flux is less than the melting temperature of the solder. In a preferred embodiment the solder used melts at about 300° C. ($T_2$) and the flux has an activation temperature, $T_1$ of about 180° C.

In FIG. 1, a solder slug 15 contains flux within cavities therein (not shown). The solder and flux are hermetically sealed within the sleeve proximate the closed end by a foil layer 16 of a relatively low melting point solder composition and a ring 18 of a relatively high melting point solder. By relatively low melting point is meant a solder which has a melting temperature at or below the activation temperature of the flux, which, as discussed above, is below the melting temperature of the solder of solder slug 15. By relatively high melting point solder is meant a solder which has a melting point higher than the activation temperature of the flux. When the connector is heated, the relatively low melting foil layer 16 melts breaking the hermetic seal. Further, melting of foil layer, 16, permits the flux, and any gaseous products of the flux formed on activation, to expand and flow toward the conductor. Ring 18 consists of a hollow cylinder of relatively high melting point solder, which preferably is the same solder composition as that used in solder slug 15. The ring not only provides the hermetic seal in combination with foil layer 16 but also provides space 17 into which the flux and the gaseous products formed therefrom, can expand. As will be evident to one skilled in the art, any other means which forms a hermetic seal until the temperature of flux activation is reached and provides expansion space for the flux, yet which does not interfere with the soldering process, can be used in place of foil layer 16 and ring 18, for example, a perforated slab, a concave disk or the like.

A piston is positioned between the solder slug 15 and the closed end 13 of the sleeve. The piston is preferably a heat activatable sealing piston 20 of the type described in copending commonly assigned U.S. patent application Ser. No. 604,791, filed Apr. 27, 1984, the disclosure of which is incorporated herein by reference. As described in that application the sealing piston 20 comprises a heat expandable polymeric material. The polymeric material can be a thermoplastic, such as polyethylene, or elastomeric such as butyl rubber, or a combination of both, for example a central core of thermoplastic material surrounded by an elastomer layer. It is preferred to use a material having good inherent lubricity, e.g. polyethylene.

The piston is preferably cross-linked to provide heat stability but this is not essential. The piston expands on application of heat thereby forming a seal between it and the peripheral inner walls of the metallic sleeve. Further the seal is maintained while the piston moves axially within the sleeve providing the diameter to length ratio of the piston is less than about 4.5:1.

To drive the piston toward the open end of the sleeve, a pressuring means 21 is positioned between the piston 20 and the closed end 13 of the sleeve. In the illustrated embodiment the pressuring means 21 comprises is preferably a gas-evolving material, such as a polymeric material, containing for example a sulfonyl hydrazide blowing agent. On application of heat gas is evolved and pressure builds up until the solder slug 15 melts. Then the pressure of the gas on the piston 21 (which has expanded to form a seal trapping the gas behind it) forces the piston to drive the solder toward the open end of the sleeve. Other pressuring means can be used, for example mechanical means such as a compressed coil spring which exerts a pressure on the piston and solder slug sufficient that on melting of the solder the spring forces the piston to drive the solder toward the open end of the sleeve.

Figure 2:
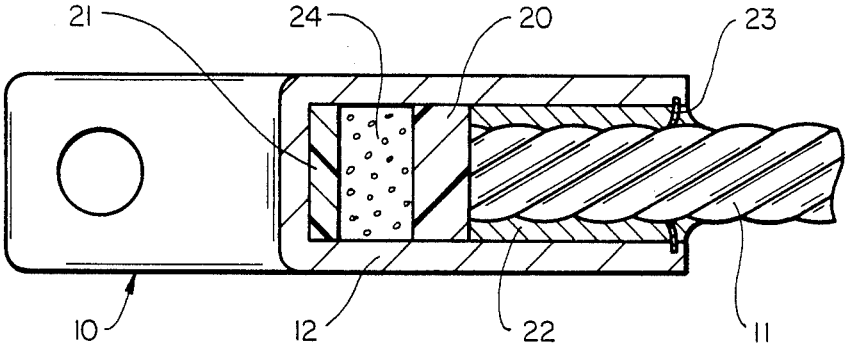
FIG. 2 shows the completed connection with the solder now connecting the conductor to the sleeve of the connector.

FIG. 2 shows the completed electrical connection between sleeve 10 and conductor 11. The solders from the main slug 15, the ring 18 and the foil layer 16 have blended together to form a solder mass 22 and been forced between the conductor 11 and the wall of connector 10. The gas-evolving material 21 has released the gas 24 which has expanded due to the applied heat and supplied the pressure to piston 15 which in turn forces solder 22 between the wall of the connector 10 and the conductor 11. Solder 22 comprises molten solder of solder slug 15 plus the solder of ring 18 and foil 16. The open end of the sleeve can be provided with retainer 23 which prevents the conductor from being dislodged from the cable by the force of the piston. A sealing compound (not shown) such as fire clay may be used at the open end to ensure that the molten solder does not flow from the connector.

While the invention has been described herein in accordance with certain preferred embodiments therof, many modifications and changes will be apparent to those skilled in the art. Accordingly, it is intended by the appended claims to cover all such modifications and changes as fall within the true spirit and scope of the invention.

I claim:

1. An electrically conductive connector for electrical conductors comprising:

(a) at least one metallic tubular sleeve having an open end for receiving an electrical conductor and a closed end, the peripheral inner wall of the sleeve being pretinned;

(b) a slug of solder having a flux associated therewith, hermetically sealed within the sleeve proximate the closed end;

(c) a piston, capable of axial motion within the sleeve, positioned between the solder slug and the closed end;

(d) means which on application of heat sufficient to raise the temperature of the connector to a first temperature, $T_1$, the activation temperature of the flux, breaks the hermetic seal and permits the activated flux to expand and flow toward the conductor; and (e) pressuring means positioned between the piston and the closed end of the sleeve which, on application of heat sufficient to raise the temperature of the connector to a second temperature, $T_2$, which is higher than the first temperature and which is the melting temperature of the solder, exerts sufficient force on the piston to cause it to move toward the open end of the sleeve and to pressure the slug of solder toward the open end of the sleeve.

2. A connector in accordance with claim 1 wherein said piston comprises a heat expandable piston capable of forming a seal with the wall of the sleeve and capable of axial motion within the sleeve.

3. A connector in accordance with claim 1 wherein said pressuring means comprises a gas evolving material.

4. A connector in accordance with claim 1 wherein said pressuring means is a compressed spring.

5. A connector in accordance with claim 1 wherein (d) comprises a sealing foil of a relatively low melting point solder and a ring of relatively high melting point solder.

* * * * *